United States Patent [19]

Svyatsky

[11] Patent Number: 4,884,797

[45] Date of Patent: Dec. 5, 1989

[54] FEEDER MODULE FOR USE IN A DOCUMENT FORWARDING SYSTEM

[75] Inventor: Eduard Svyatsky, Chicago, Ill.

[73] Assignee: Bell & Howell Company, Chicago, Ill.

[21] Appl. No.: 109,714

[22] Filed: Oct. 16, 1987

[51] Int. Cl.[4] ..... B65H 1/02

[52] U.S. Cl. ..... 271/126; 271/150; 271/155; 271/160

[58] Field of Search ..... 271/150, 151, 154, 155, 271/37, 38, 31.1, 117, 126

[56] References Cited

U.S. PATENT DOCUMENTS 3,709,482 1/1973 Nelson ..... 271/37
3,966,193 6/1976 Storace ..... 271/150
4,275,875 6/1981 Akers ..... 271/31.1 X
4,432,540 2/1984 Akers ..... 271/31.1 X

*Primary Examiner*—Richard A. Schacher
*Attorney, Agent, or Firm*—Laff, Whitesel, Conte & Saret

[57] ABSTRACT

A feeder for a stack of upright documents includes a horizontally disposed receptacle having a planar base and a side restrainer. A spring loaded back plate and a fanning device move the stack form one end of the base to the other end adjacent a separator. The fanning device, which includes a plurality of movable belts projecting above the planar base each having a different rate of linear speed relative to one another, cause individual documents to fan away from the stack and thereby relieves pressure.

25 Claims, 3 Drawing Sheets

$V_1 < V_2 < V_3$ $V_4 = V_5 < V_6$

FEEDER MODULE FOR USE IN A DOCUMENT FORWARDING SYSTEM

BACKGROUND AND BRIEF DESCRIPTION OF THE INVENTION

This invention relates in general to the handling of mail and, in particular, to a feeder module for use in an improved forwarding address system for use with mail sorting machines.

The volume of mail handled daily by large businesses, institutions and governmental entities has steadily increased through the years. For example, credit card companies, utilities, mail order houses and other advertisers send and receive huge quantities of mail daily. Typically, the envelopes containing the material to be mailed are addressed and then sorted into common groups for mailing. Similarly, mail received by such entities is commonly sorted into groups based the subject matter of the received material. A third category of such envelopes are the returned mail category the creation of which is primarily due to the addressee having moved from a particular address resulting in the envelope being undeliverable. The present invention relates to a feeder module for individually separating documents or envelopes and feeding them to further areas in a larger system. One such system where the present invention can be utilized is directed to the solution of this wrong address problem, namely, the correction of the address by application of a secondary label to the envelope with the correct forwarding address that will permit its proper delivery.

Several different types of machines have been developed to assist in the handling of such mail, other than manual review and correction by the individual mail carrier. These prior art devices typically comprised an envelope feeder, a read station, a selection of label station where a supply of labels permitted selection of an appropriate label and its application to an envelope, and a sorting and storage means.

None of these prior art machines and systems proved satisfactory since they were large unwieldy machines that required not only a large amount of space but also required frequent replenishment of a vast array of preprinted label supplies and applicating equipment.

The present invention relates to a feeder module having a unique envelope feeder apparatus wherein incoming envelopes are separated from each other and delivered to a transport module both of which are part of a unique computer-operator controlled system with a plurality of unique stations that are suitable for use with conventional mail sorting machines. The transport module moves the envelope or document through a plurality of read stations that are provided with a single visual reporting means and input keyboard means tied to a main computer data source for use and control by an operator. Observation of indicia by the operator and selective input into the keyboard means results in an electable response being presented for use by the operator, the elected information then being sent to a print module for use in creation of an appropriate corrective label.

The feeder module utilizing the teaching of the present invention includes means whereby a stack of envelopes or documents are maintained in an upright edgewise orientation and are fanned outwardly from one another to permit movement of individual envelopes, regardless of thickness, into the nip of the shifting rollers located at one end of the feeder module for lateral movement to the next station. By having the feeder module extending outwardly perpendicular to the balance of the machine the operator can be positioned adjacent to it and readily handle any problems, if any, that might arise at his elbow.

Still another object of the invention is to provide a feeder module of the type contemplated that will reliably operate over extended time parameters with minimal down times, as well as being relatively simple and economical to construct and operate.

Other and further objects of this invention, together with all of the features of novelty appurtenant thereto, will appear in the course of the following description.

DETAILED DESCRIPTION OF THE INVENTION

Figure 1:
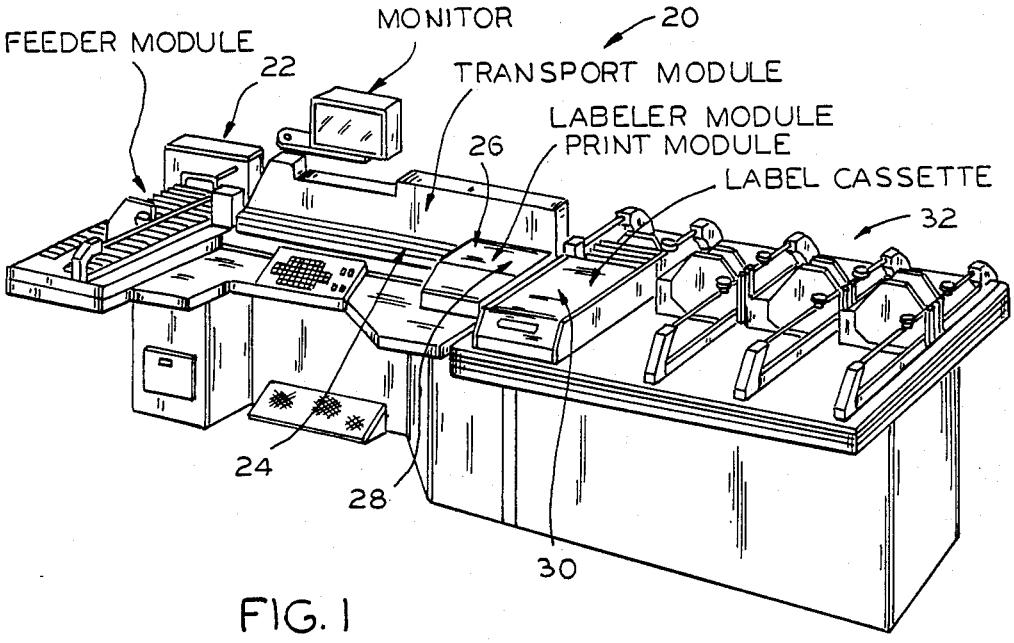
FIG. 1 is a perspective view of a document forwarding system of the type capable of utilizing the feeder module contemplated by the present invention.

Referring now to the drawing, wherein similar parts are designated by similar numerals, and particularly FIG. 1, a computer assisted document forwarding system of the type contemplated to utilize the present invention, and generally designated by the numeral 20, includes an integrated system of several modules, each of which in that system are interrelated with the other and mutually interdependent. However, certain of the modules in that system and particularly the feeder module contemplated by the present invention can operate independently or be integrated into other systems.

Forwarding systems, of the type shown in FIG. 1, are designed to reduce the labor factor involved in updating a mailing list and also to accurately forward mail that has been erroneously deposited at a local post office.

A forwarding system of the type contemplating the utilization of the present invention would include a feeder module 22, a transport module 24 which has a plurality of observation means stations, a print module 26, a labeler module 28, a label cassette 30, and a sorting and stacking module 32. It is such a system, referred to earlier, that can be used by the local post offices where documents, i.e. mail envelopes of various sizes, have been stopped because a customer has entered a change of address order and hence existing documents are not properly addressed for delivery purposes.

The forwarding correcting system is basically an ancillary arm to a master computer where all of the address changes are fed and maintained for a predetermined time frame. The information in the master computer is made available to the subsidiary or remote stations for use by an operator to update on a ready basis the address to which particular pieces of mail are to be forwarded.

Figure 2:
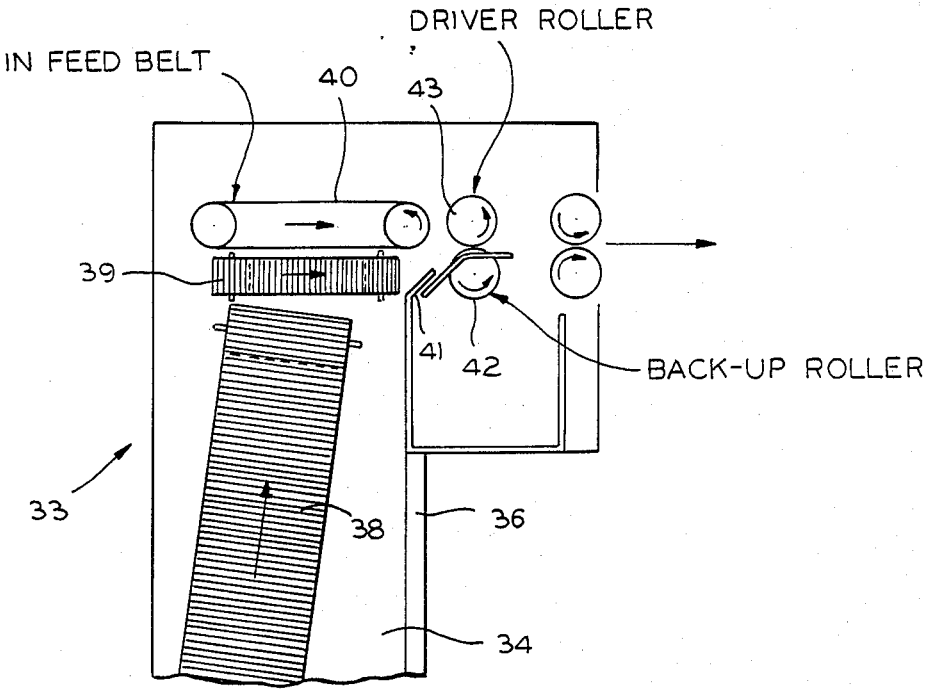
FIG. 2 is a schematic plan view of a prior art feeder device having a function somewhat related to the present invention.

One form of prior art feeder means, as shown in FIG. 2., includes a flat elongated base 34 having a flange-like rail 36 along at least one edge thereof. An angled moveable belt-means 38 carries stacks of edge supported envelopes toward the upper end, as seen in the drawing, and because of its angled disposition it tends to force the envelopes laterally against the rail 36. The angled belt 38 moves the stack over the horizontal transversely disposed moving belt 39 moving in generally the same horizontal plane as belt 38. A vertically disposed belt 40 moves transversely in the same direction and at about the same speed as belt 39 and was designed to move the first envelope laterally into the nip of rollers 42–43. The angled wall 41, an extension of the side rail 36, was designed to direct the envelopes moved by belt 39 in the general direction of the nip of the rollers 42–43, however, it has been found that this action by the horizontal belt 39 toward angled wall 41 tends to move more than one envelope out of the stack and causes bunching and jamming. Thus, this feeder lacked the necessary consistency necessary for this type of operation.

Figures 3, 3A, 3B:
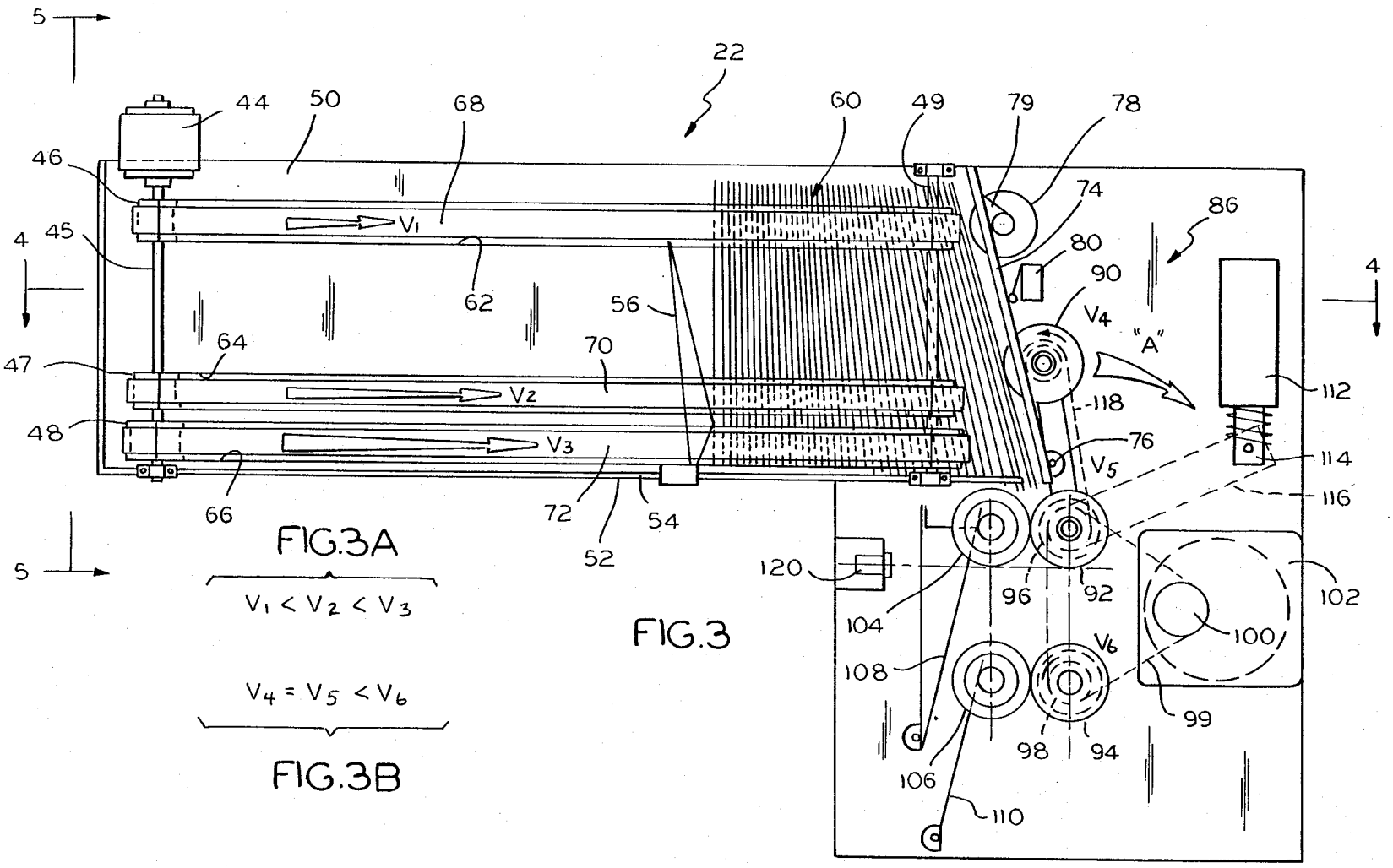
FIG. 3 is a plan view of the feeder module of the present invention having the protective hood shown in FIG. 1 removed from the far end of the feeder tray for clarity in illustration.
FIGS. 3A and 3B are diagrammatic representations of the velocities of various elements utilized in the feeder module.

Referring now to FIGS. 3 through 6, and particularly FIG. 3, the feeder module 22 of the present invention includes an elongated planar base 50, which is shown as being transparent in FIG. 3 for ease in observation of the mechanisms located below the base. The transparency is not a necessity in practical operation. Along one edge there is provided an abutment or wall 52 carrying a slide or track means 54. Means 54 is adapted to accept a spring loaded back plate 56 for purposes of moving a stack 60 of envelopes standing upright on their elongated edges from one end of the base 50 to the other end.

To assist in the movement of the stack 60, the base 50 includes a plurality of spaced parallel slots. In this embodiment the slots are three in number and are indicated as 62, 64, and 66. A plurality of belt-like members 68, 70, and 72 are disposed respectively in slots 62, 64, and 66 and project slightly above the plane of base 50. Each of the belt-like members in operation has a different rate of linear speed relative to each other. In the preferred embodiment the spaced movable means, or belts, each have a relatively progressive increase in velocity as measured transversely from one edge of the base to the opposite edge. As seen in FIG. 3, the length of the arrows $B_1$, $B_2$, and $B_3$ indicate the relative velocities of these belt-like members. A single power source in the form of motor 44 is provided with an elongated shaft 45 having a plurality of spaced driving drums 46, 47 and 48 with differing diameters and positioned in an ever increasing order of size along the shaft 45. In this fashion a constant speed motor 44 will provide the belts with differing velocities due to the linear speed developed as the belts 68–72 pass over the differing sizes of driving drums 46, 47, and 48. The opposite ends of the belts are supported on idler pulleys mounted on shaft 49 that is maintained in position by pillow blocks at its opposite ends. FIG. 3A discloses algebraically the relationship of the velocities of the belts in progressive increasing order as measured across the planar base 50.

When documents that are standing on their edge on the base 50 are moved forward by the differing velocities of these belts, and assisted by the back plate 56, the end of the document edge contiguous to the belt having the highest velocity will tend to fan away from the stack and present one end canted and spaced from the stack for easy separation therefrom by suitable means such as a feeder wheel to move the document out of the stack and into the transporter module.

As the stack is moved along the base 50, to the right as viewed in FIG. 3, the stack 60 will confront a plate-like member 74 that is pivoted at one end as at 76. The plate 74 is spring loaded about pivot 76 and carries at its other end, opposite pivot 76, a rotatable wheel means 78 spring loaded by spring 79 to confront and provide ease in movement of the first envelope in the stack 60. When the plate 74 is confronted by excessive pressure from the stack the plate will rotate clockwise, as viewed in FIG. 3, about the pivot 76 and will engage switch means 80. When switch 80 is activated by the pivoted plate 74 it puts out a signal that stops motor 44 and the feeding motion of the belts until the excessive pressure is relieved by removal of documents from the stack whereupon switch 80 is deactivated and the motor turned back on.

Also located at the right hand end of base 50 is a feeder mechanism 86 having a plurality of pairs of spaced wheel means mounted on common shafts for gripping the envelopes at spaced vertical locations to provide a smooth unskewed movement of the envelopes serially from the feeder module to the transport module. The first pair of such wheels are the feed wheel means 90 which are adapted to extend through suitable slot means in the plate 74 to thereby permit engagement of the feed wheel means 90 with the first envelope in the stack. The wheels 90 are serrated for the purpose of providing increased friction or alternatively the wheels 90 can be provided with a decreased durometer so that they bite and can insure movement of the first envelope in the stack when contacted by the wheels 90. The feed wheel means 90 are mounted on a common shaft carried by a movable arm 118 which permits the feed wheel means to move in and out of engagement with the first document on the stack for purposes set forth hereinafter.

When the feed wheels 90 engage the document it is moved into position in the nip between the first pair of driven rollers 92 and spring loaded back-up rollers 94. This first double pair of rollers are adapted to move the first document laterally away from the stack when the feed wheels 90 initiate envelope movement toward the nip of the first driven rollers 92. The feeder module 86 then presents a second pair of vertically spaced driven rollers 94 opposed by spring loaded back-up rollers 96 in juxtaposed moveable opposition thereto and with the second pair of driven rollers being generally aligned with the first pair of driven rollers but spaced laterally therefrom and having a higher speed than the first pair of driven rollers. This is accomplished by having a common power source in the form of a motor 102 having a pulley 100 on its power shaft carrying a common belt 99 for driving rollers 92 and 94. The pulley engages and passes over pulley 96 (connected to first rollers 92) with pulley 96 having an override clutch means integrally built therein and with pulley 96 having a first predetermined diameter. The belt 99 then continues over a smaller diameter pulley 98 (driving rollers 94) with the belt 99 driving rollers 94 at a higher speed than rollers 92 due to the constant linear movement of the belt 99 and the difference in the diametral measurement of the two pulleys. Thus, with the driven rollers 94 moving at a higher speed than rollers 92 the document will be pulled from engagement with rollers 92 (overriding the clutch in pulley 96) and moved into the transport module as will be explained hereafter. The facing or back-up rollers 104 and 106 are maintained in moveable engaging positions with the respective driven rollers by means of the springs 108 and 110.

The presence or absence of an envelope between the driven rollers 92 and 94 is detected by suitable means 120 i.e. an electric eye photocell or an infra red detector, or any other suitable detection means. The presence of an envelope in that position activates the solenoid 112 which through its spring loaded power arm 114 causes another connected arm 116 that is fixedly connected to arm 118 to move the feeder wheels 90 in the direction of arrow A, as seen in FIG. 3. In this fashion the feeder wheel 90 is disengaged and prevented from delivering another envelope out of the stack 60. When the blocking document clears the detection means the power is de-energized and the feed wheel means then moves in a direction opposite to arrow A into engagement with the next document.

It will be noted that a common belt 91 is used to drive the pulleys which connect the feed wheels 90 and the first pair of rollers 92, said pulleys being of the same size. Therefore, the velocities, as best seen in algebraic symbolism in FIG. 3B, of the feed wheels 90 and the first set of rollers 91 are designated Velocity 4 and Velocity 5 and are equal, but both are less than the velocity of the next pair of rollers 94. Rollers 94, as was previously noted, are driven by pulley 98 having a smaller diameter than the pulley 96 to thereby provide a faster linear speed and which will literally pull an envelope out of the nip between the rollers 92 and the idler wheels 104 by permissive slippage of the overriding clutch in pulley 96.

Figure 4:
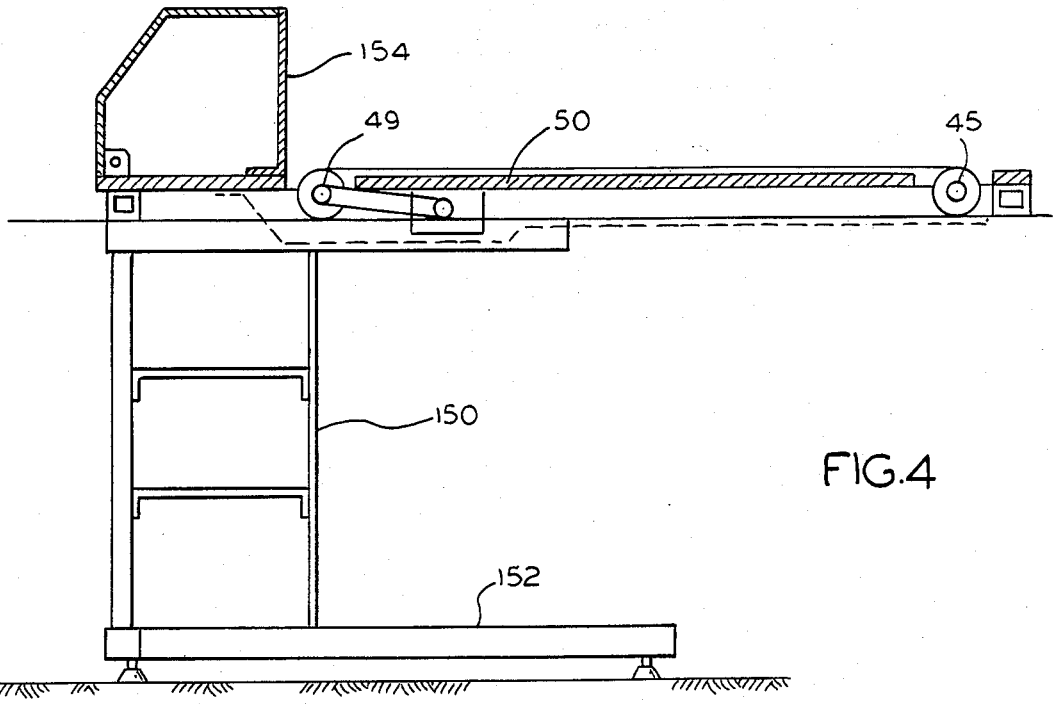
FIG. 4 is a partial side elevational view in partial section of the feeder module showing the cantilever disposition of a substantial portion of said module.

FIG. 4 discloses the stiff generally rigid cantilever construction extending forwardly from the oversize column 150 supported by suitable base means 152. The cover 154 encloses the separation system 86, the details of which are omitted from this figure.

Figure 5:
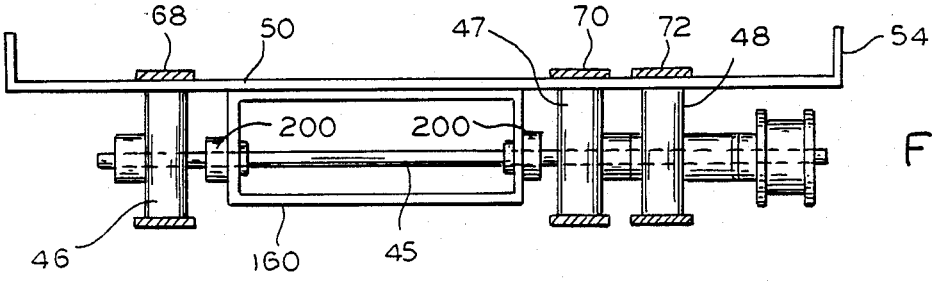
FIG. 5 is a partial end view in partial section of the module of FIG. 4.
Figure 6:
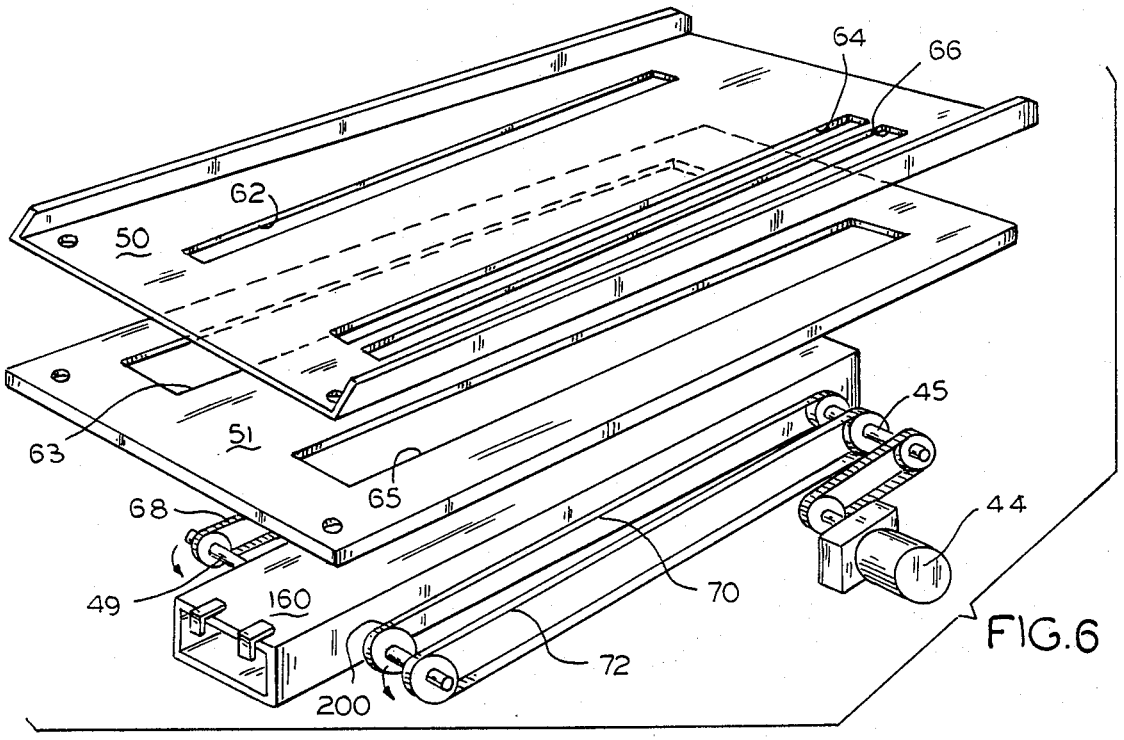
FIG. 6 is an exploded perspective view of the major elements of the feeder tray and associated moving belts utilized in a feeder module of the type contemplated by the present invention.

FIGS. 5 and 6 provide additional detail of the construction of the feeder module. An extrusion channel 160 provides the rigidity for the cantilever construction and serves to support the feed tray 50 as well as to provide internal support for the centrally disposed bearings 200 for the shafts 45 and 49. The feed tray 50 has the parallel slots 62, 64, and 66 previously described. In certain instances, dependent upon the type of documents being handled, i.e. their relative size and weight, it may be desirable to provide a secondary support plate 51 to reinforce the feed tray 50. To provide a universality to plate 51 it is provided with two extra wide parallel slots 63 and 65 that are adapted to accept not only the single belt 68 but also the double belts 70 and 72, regardless of the orientation of plate 51.

Other means for applying labels to envelopes or packages will be apparent to those skilled in the art and mechanical equivalents to those indicated above will be called to mind, however, it felt that this invention should be limited only by the claims attached hereto.

I claim:

1. A horizontal feeder means for feeding documents including means for fanning said documents to assist in the sequential delivery of a single document to a lateral position, said feeder means includes a generally horizontally disposed receptacle having an elongated substantially planar base and at least one side restraining means adapted to accept a plurality of documents each having the lower one edge engaging said base in generally transverse vertically oriented document disposition, means providing a bias of force against the stack of said plurality of documents, said fanning means including at least two means exerting at least two spaced points of force against said lower one edge of each said document, said fanning means including a plurality of movable means exposed in said planar base and adapted to contact said lower document edge at spaced points and said movable means having differing velocities of motion in the same direction.

2. A feeder means of the type claimed in claim 1 wherein said movable means includes a plurality of belt-like members positioned within spaced parallel slot means disposed in said base and having different rates of linear speed relative to each other.

3. A feeder means of the type claimed in claim 1 wherein said spaced movable means have a relatively progressive increase in velocity as measured transversely from one edge of said base to the opposite edge.

4. A feeder means of the type claimed in claim 2 wherein said spaced plurality of belt-like members each have a progressively increased velocity greater than the velocity of the next adjacent belt-like member when moving along a transverse viewing line of sight relative to said base.

5. A feeder means of the type claimed in claim 4 wherein said belt-like members utilize a single power source.

6. A feeder means of the type claimed in claim 5 wherein said belt-like members are driven by a plurality of driving drums having differing diameters.

7. A feeder means of the type claimed in claim 8 wherein said driving drums are arranged in an ever increasing order of size and disposed in spaced relation along shaft means interconnected with a common power source.

8. A feeder means of the type claimed in claim 1 wherein said feeder includes an elongated generally planar base, a plurality of spaced generally parallel slots extending along the length of said base, an equal number belt means disposed in said slots and moving at increasing rates of speed such that their relative velocities would be expressed as follows, namely, $V_1, V_2 \ldots V_n$, whereby said documents standing on their edge on said base will tend to cant from end to end and be angularly disposed transversely of said base, the end of said document edge contiguous to the belt having the highest velocity will tend to fan away from said stack and present an end spaced from said stack for easy separation therefrom by suitable means to move the document out of the stack onto the transporter.

9. A feeder means of the type claimed in claim 8 wherein said feeder includes spring loaded means in the form of a movable back plate for moving the stack of documents from one end of said base toward the other end as documents are removed and transferred laterally to an adjacent position, pivotable angled plate means confronting said stack at said other end of said base, pressure responsive control means adapted to turn off the power source driving said belts when the pressure of said stack against said pivoted plate means exceeds a predetermined level.

10. A feeder means of the type claimed in claim 9 wherein said pivotable plate is spring loaded and adapted to rotate about a pivot adjacent one end of said pivotable plate and move against said spring when confronted by excessive pressure from said stack, switch means activated by said moved pivotable plate and stopping motion by said belts until said excessive pressure is relieved by removal of documents from said stack.

11. A feeder means of the type claimed in claim 9 wherein said feeder includes a feed wheel means adapted to engage the first document in said stack adjacent said angled plate and cause said first document to move laterally away from said feeder base, said feed wheel means including means for controlling its position of engagement with the first document in said stack of documents.

12. A feeder means of the type claimed in claim 11 wherein said feeder includes a first driven roller and a spring loaded back-up roller in opposition thereto and adapted to accept and move said first document away from said feeder when said feeder roller initiates movement of said first document away from said feeder towards said first driven roller.

13. A feeder means of the type claimed in claim 12 wherein said feeder includes detection means for determining the presence or absence of document means adjacent and beyond said first set of rollers, said detection means controlling the feed wheel means between an engaged and a disengaged position to thereby prevent inadvertent jams by having more than one document in transit between the first pair of driven and back-up rollers that lead from the feeder means to the laterally adjacent position.

14. A feeder means of the type claimed in claim 13 wherein said detection means includes a path interrupting photo cell, said feed wheel means being carried by a spring loaded power activated pivot arm, circuitry including said detection means that energized said power for activating said arm whereby said feed wheel means is disengaged until said document clears said detection means whereby said power is deenergized and said feed wheel means engages and moves the next document.

15. A feeder means of the type claimed in claim 14 wherein said activating pivot arm pivots about the axis of the first driven roller.

16. A feeder means of the type claimed in claim 13 wherein said feed wheel means and said first driven roller each include means for contacting said document at vertically spaced points to thereby ensure vertical stability of said documents during passage between said feeder and delivery laterally thereof.

17. A feeder means of the type claimed in claim 13 wherein each of said feed wheel means and said first driven roller and back-up rollers include two spaced rollers on a common axis to thereby contact and grip said documents at vertically spaced points.

18. A document feeding system for feeding individual generally flat documents from a generally horizontally disposed edge stack of documents, including means for fanning said documents to assist in the sequential delivery of single documents from said document feeding system, said system comprising a generally horizontally disposed receptacle having an elongated substantially planar base and at least one side restraining means adapted to accept a plurality of documents each having the lower one edge engaging said base in generally transverse vertically oriented document disposition, means providing a bias of force against the stack of said plurality of documents, said fanning means including a plurality of movable means exposed in said planar base and adapted to contact said lower document edge at spaced points and said movable means having differing velocities of motion in the same direction.

19. The document feeding system of claim 18 wherein said movable means includes a plurality of belt-like members positioned within spaced parallel of belt-like members positioned within spaced parallel slot means disposed in said base and having different rates of linear speed relative to each other.

20. The document feeding system of claim 18 wherein said spaced movable means have a relatively progressive increase in velocity as measured transversely from one edge of said base to the opposite edge.

21. The document feeding system of claim 19 wherein said belt-like members are driven by a plurality of driving drums having differing diameters, said driving drums being arranged in an ever increasing order of size and disposed in spaced relation along shaft means interconnected to a single power source.

22. The document feeding system of claim 21 wherein said driving drums are each mounted in spaced relation on a common shaft means interconnected to said single power source.

23. The document feed system of claim 22 wherein said horizontally disposed receptacle includes an elongated generally planar base, a plurality of spaced generally parallel slots extending along the length of said base, an equal number of belt means disposed in said slots and moving at increasing rates of speed such that their relative velocities would be expressed as follows, namely, V1, V2 . . . Vn whereby said documents standing on their edge on said base will tend to cant from end to end and be angularly disposed transversely of said base, the ends of said document edges contiguous to the belt having the highest velocity tending to fan away from said stack and present an end spaced from said stack for easy separation therefrom by suitable means to advance the document out of the stack.

24. A document feeding system for feeding individual generally flat documents from a generally horizontally disposed edge stack of documents, including a generally horizontally disposed receptacle having an elongated substantially planar base, a plurality of movable belt-like members positioned along said base and exerting a force against a lower edge of each said document tending to move said documents from one end of said base toward the other end, a movable back plate for assisting the movement of the stack of documents from one end of said base toward the other end as documents are removed and transferred from said document feeding system, pivotable angled plate means confronting said stack at said other end of said base, said pivotable plate is spring loaded and adapted to rotate about a pivot adjacent one end of said pivotable plate and move against said spring when confronted by excessive pressure from said stack, pressure responsive control means adapted to turn off the power source driving said belt-like members when the pressure of said stack against said pivoted plate means exceeds a predetermined level said pressure responsive control means including switch means activated by said moved pivotable plate and stopping motion by said belt-like members until said excessive pressure is relieved by removal of documents from said stack.

25. The document feeding system of claim 24 wherein said angled plate means includes means to accept feed wheel means adapted to engage the first document in said stack adjacent said angled plate and cause the first document in said stack to move laterally away from said receptacle base, said feed wheel means including means for controlling its position of engagement with said first document in said stack of documents, said feed wheel means being continually rotated about its central axis by power drive means associated with said document feeding system, said controlling means alternatively moving said feed wheel into and out of sequential engagement with said first document in said stack while said feed wheel is continually rotating.

* * * * *